United States Patent [19]

Griesinger et al.

[11] Patent Number: 4,637,172

[45] Date of Patent: Jan. 20, 1987

[54] METHOD AND APPARATUS FOR TREATING OPEN-END FRICTION SPINNING ROLLERS

[75] Inventors: Rolf Griesinger, Göppingen-Faurndau; Gerhard Fetzer, Süssen, both of Fed. Rep. of Germany

[73] Assignee: Spindelfabrik Sussen, Schurr, Stahlecker, Fed. Rep. of Germany

[21] Appl. No.: 677,464

[22] Filed: Dec. 3, 1984

[30] Foreign Application Priority Data

Dec. 1, 1983 [DE] Fed. Rep. of Germany ..... 3343484

[51] Int. Cl.[4] ..... B24B 21/02

[52] U.S. Cl. ..... 51/289 R; 51/135 R; 51/145 R; 51/328

[58] Field of Search ..... 51/62, 67, 103 C, 105, 51/106 R, 129, 131.1, 132, 135 R, 143, 144, 145 R, 146, 154, 161, 273, 289 R, 328, 394, 399, 401, 251; 15/256.51, 256.53; 19/262; 100/174

[56] References Cited

U.S. PATENT DOCUMENTS

| | | | |
|---|---|---|---|
| 2,418,871 | 4/1947 | Danielson | 51/103 C |
| 2,479,929 | 8/1949 | Harris | 51/401 |
| 2,518,836 | 8/1950 | Tanner | 51/289 R X |
| 2,525,591 | 10/1950 | Cotchett | 51/289 R |
| 3,157,967 | 11/1964 | Lachere | 51/144 |
| 3,427,755 | 2/1969 | Levesque et al. | 51/105 R |
| 3,498,006 | 3/1970 | Lang et al. | 51/105 R |

*Primary Examiner*—Robert P. Olszewski

*Attorney, Agent, or Firm*—Barnes & Thornburg

[57] ABSTRACT

A method and apparatus is provided for treating the surfaces of a pair of rollers used in an open-end friction spinning unit containing a pair of friction rollers arranged in an operational position to form a wedge-shaped yarn-forming gap. The pair of friction rollers is treated prior to installation in a spinning unit by rotatably mounting the two friction rollers adjacent one another outside the spinning unit, causing the friction rollers to rotate on their longitudinal axes and simultaneously treating the surface of each friction roller with common treating element.

21 Claims, 4 Drawing Figures

METHOD AND APPARATUS FOR TREATING OPEN-END FRICTION SPINNING ROLLERS

BACKGROUND AND SUMMARY OF THE INVENTION

This invention relates to a process and an apparatus for treating the surfaces of friction rollers for open-end friction spinning units which are each equipped with two rollers adjacent one another and forming a wedge-shaped gap.

In the operation of an open-end friction spinning unit, the distance between the rollers forming the wedge-shaped gap in which the yarn is formed is of considerable importance. In order to be able to spin a relatively fine yarn, the wedge-shaped gap must be relatively narrow. For this purpose, the rollers are arranged at a distance from one another of only a few hundredths of a millimeter. Also, the wedge-shaped gap must not change its width during the operation, i.e., each roller surface must have precise concentricity relative to its axis of rotation. If the rollers are not completely round, the width of the wedge-shaped gap will change constantly so that the friction characteristics in the wedge-shaped gap will change correspondingly. With the changing friction characteristics, the twist applied to the yarn also changes, thereby resulting in the danger that thick and thin points may occur in the yarn.

An objective of the present invention is to provide a process and apparatus for treating the surfaces of rollers by which the concentricity of the rollers can be made more precise.

This objective is achieved according to the invention by treating the surfaces of two rollers jointly during at least the last roller preparing cycle and installing these two rollers as a pair in one spinning unit.

By means of the joint treatment of their surfaces, the rollers are mated with one another. By then installing them together for use in one spinning unit, problems due to the use of two rollers which may each have large surface irregularities are avoided.

In one aspect of the present invention, two rollers are mounted, driven and simultaneously treated by a polishing or grinding element in a position that corresponds to their operational position in a spinning unit. This apsect is advantageous because during the treating, the two rollers take up their later operational orientation with respect to one another resulting in a further increase of the precision of concentricity. In this case, it is especially advantageous to press the two rollers with biasing means against a polishing or grinding means disposed between them. As a result during the polishing or grinding phase, out of round conditions in the rollers are diminished.

It is contemplated that rollers be driven at speeds that differ from one another during their surface treatment. This ensures that during turning the same points of the two rollers are not always opposite one another. In this way slight indentations or elevations in the roller surfaces are not increased, but are actually diminished.

It is further contemplated that the rollers are driven in the same rotational direction. The rollers therefore move in relation to one another in a manner that is similar to their later operation in the spinning unit.

In a further development of the invention, the polishing or grinding means is driven at a speed that differs from the circumferential speed of the rollers. This ensures that the polishing or grinding means is always applied to different areas on the surfaces of the rollers so that over an extended period of time, a uniform method of operation of the polishing or grinding means can be ensured.

In an especially advantageous development of the invention, the rollers are combined with bearings to form one structural unit and are treated in this condition before carrying out the last treatment phase of their surfaces. As a result, those out of round errors that may possibly be caused by their bearings will be worked off in the last roller preparing cycle.

In a further development of the invention, in order to provide an apparatus for treating the surfaces of rollers, receiving means are provided for receiving two rollers in an orientation with respect to one another that corresponds to their operational orientation in a spinning unit. Also provided are drives for the two rollers and at least one polishing or grinding element for simultaneously treating the surfaces of both rollers. By means of this apparatus, the two rollers that will later be used jointly in a spinning unit are treated in such a way that a high measure of mutual concentricity is obtained at least during the last preparing cycle which determines the final shape of their surfaces.

In a further development of the invention, it is provided that the receiving means are biased in such a way that the two rollers rest against the polishing or grinding element disposed between them with a predetermined force. As a result, a uniform effect on the surfaces of both rollers due to the polishing or grinding means is obtained.

In a further development of the invention, it is provided that between the receiving means of the rollers, a belt is arranged that is equipped with a polishing or grinding coating on both sides. Advantageously, the belt is designed as a rotating driven continuous loop, resulting in a simple and reliably operating apparatus. It is advantageous in this case that the width of the belt corresponds to the length of the surfaces of the rollers to be treated. This results in a uniform treatment of the surfaces, especially the area which later is opposite the mouth of a fiber feeding channel when the rollers are positioned within the spinning unit. It is in this vicinity that the actual formation of the yarn takes place.

In a further development of the invention, the rollers are disposed on shafts that can be clamped into the receiving means. In this case, it is especially advantageous that tube-shaped suction inserts are provided as shafts on which the rollers, designed as cylinders, are disposed by means of roller bearings. The receiving means are designed corresponding to the holders of the suction inserts of a spinning unit. Thus the rollers are completely combined with their bearings and shafts before they are subjected to the last treatment. Imprecisions with respect to concentricity caused by the bearings and shafts will therefore also be eliminated.

Further objects, features, and advantages of the present invention will become more apparent from the following description when taken with the accompanying drawings which show, for purposes of illustration only, embodiments constructed in accordance with the present invention.

DETAILED DESCRIPTION OF THE DRAWINGS

Figure 1:
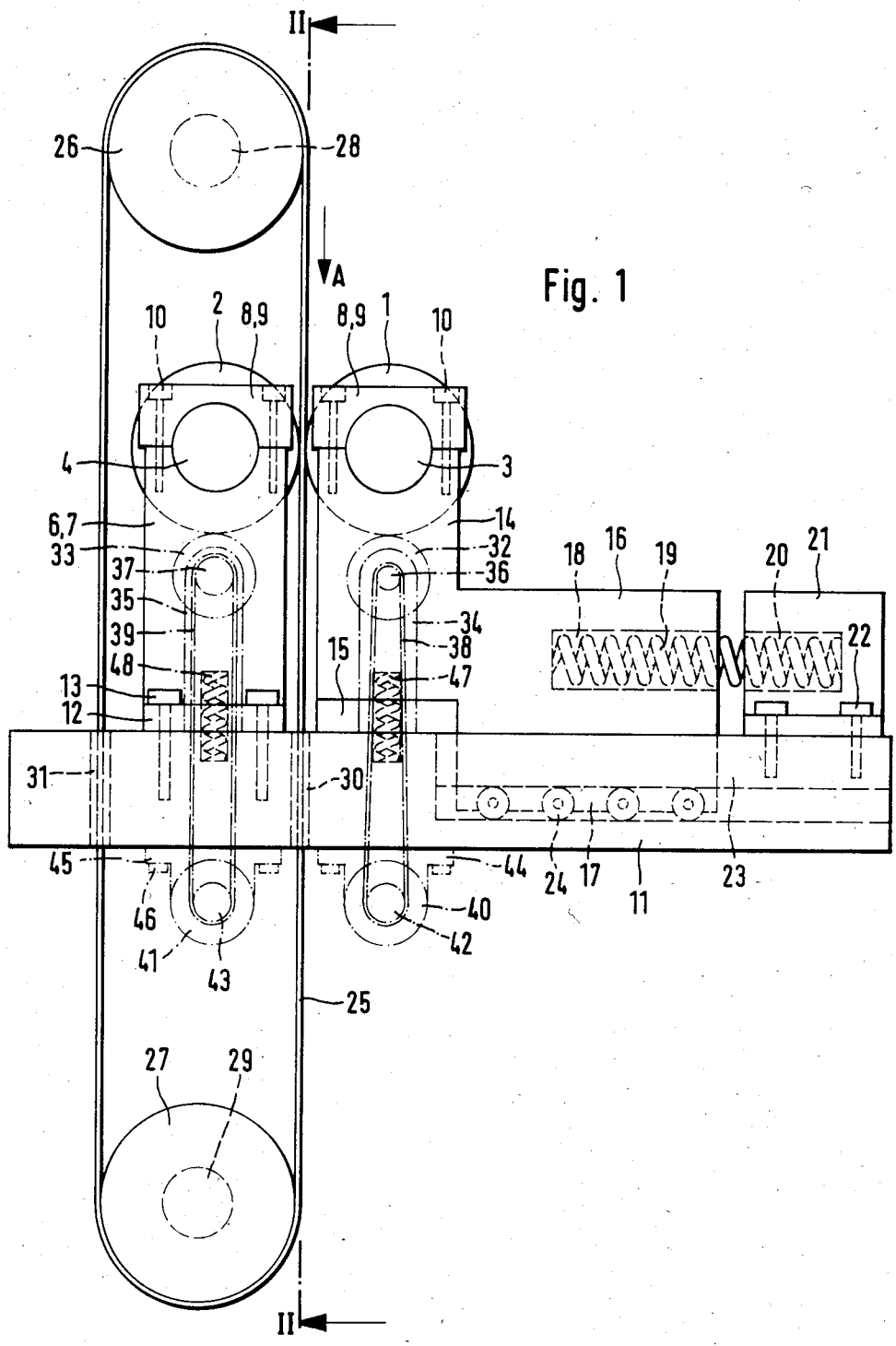
FIG. 1 is a sectional view of an apparatus according to the invention for the simultaneous treatment of the surfaces of both rollers of a roller pair constructed according to a preferred embodiment of the invention.

The apparatus shown in FIGS. 1 and 2 comprises a means for treating the surfaces of two rollers 1 and 2 which later will be arranged in spinning unit (FIG. 4) exactly in parallel next to one another and separated by only a few hundredths of a millimeter. In the apparatus, the two rollers 1 and 2 are arranged in a position that corresponds to their operational position in a spinning unit, i.e., also exactly in parallel to one another but positioned at a greater radial distance from one another. By means of this apparatus, a final grinding or polishing of the cylindrical surfaces of rollers 1 and 2 is accomplished, thereby determining the final shape of the cylindrical surfaces. This final treatment may be preceded by other treatments such as coarser grinding and/or coating. The two rollers 1 and 2 which are treated simultaneously in the apparatus will then be built into a spinning unit as a pair of rollers. When rollers 1 and 2 are subjected to individual treatment in corresponding grinding or polishing machines, a maximal mutual concentricity of 20 to 30 micrometers can be obtained even in the case of the most careful treatment. The simultaneous treatment according to the present invention can improve concentricity to values of 4 to 6 micrometers, i.e., by almost one order of magnitude. The result is a corresponding consistency in the spinning conditions which leads to a more uniform yarn in friction spinning.

The two rollers 1 and 2 consist of cylinders which are disposed on shafts 3 and 4 by means of roller bearings 5. The shafts 3 and 4 are designed as so-called suction inserts (FIG. 4) which are provided with suction slots 56 and 57 extending in the axial direction. The suction slots are disposed opposite the wedge-shaped gap 54 and delimited by webs. The rollers 1 and 2, preassembled with their bearings 5 and shafts 3 and 4, are then installed into the apparatus according to FIGS. 1 and 2. The apparatus has two stationary holders 6 and 7 equipped with receiving means for the shaft 4 of roller 2. The shaft 4 is clamped tightly to the receiving means of the holders 6 and 7 by means of tool holders 8 and 9. The holders 6 and 7 which themselves may be connected with one another by connecting means have flanges 12 which are fastened on a very rigid base plate 11 by means of screws 13. For the shaft 3 of the other roller 1, two holders 14 are also provided which are similarly equipped with receiving means in which the shaft 3 is clamped tight by means of tool holders 8 and 9 fastened by means of screws 10.

The two holders 14, which may be connected with one another by connecting means, are arranged in the base plate 11 in such a way that the shaft 3, and thus also the roller 1 are aligned exactly in parallel to the shaft 4 and thus to the roller 2. On the side opposite the holders 6 and 7, the holders 14 are provided with a projection 16 arranged in a recess 23 of the base plate 11. The projection 16 is provided with pulleys 24 on both sides which are guided in rail-type guides 17 of the base plate 11 so that the displacement resistance for the holder 14 is very minimal. A limiting stop 21 is attached to the base plate 11 by means of fastening screws 22. Pressure springs 19 are supported by the limiting stop 21 in recesses 20. The other ends of the pressure springs 19 are guided in recesses 18 of the projections 16. By means of these pressure springs 19, the holders 14 are biased in the direction of the holders 6 and 7 with an adjustable force so that the surfaces of the rollers 1 and 2 are pressed against one another in the radial direction.

A continuous belt 25 runs between the surfaces of the rollers 1 and 2. This belt 25 is provided with a polishing or grinding coating on both sides. The continuous belt 25 is guided through slot-shaped recesses 30 and 31 in the base plate 11 and is wound around a driving wheel 27 driven by a shaft 29 and around a deflection pulley 26 disposed on a shaft 28. The belt 25 is driven in the direction of the arrow A.

Each roller is driven by a friction wheel 32, 33 which is applied tangentially to the surface of the roller. The friction wheels 32 and 33 are mounted on spring biased holders 34 and 35 that can be shifted radially with respect to the rollers 1 and 2. The biasing force is determined by the pressure springs 47 and 48. Gears 36 and 37 are connected with friction wheels 32 and 33. The gears 36 and 37 are driven by pinions 42 and 43 of electric motors 40 and 41 via toothed belts 38 and 39. These motors are fastened to the base plate 11 by means of flanges 44 and 45 and screws 46. The driving of the rollers 1 and 2 takes place in such a way that the surfaces of the rollers 1 and 2 have different circumferential speeds. For this purpose, the gears 36 and 37 may be of different size. The rollers 1 and 2 are advantageously driven in such a way that they turn in opposite rotational directions so that their surfaces move in the same direction relative to the belt 25, i.e. both surfaces move in the direction of the belt or both surfaces move in a direction opposite the direction of the belt. When the belt 25 runs in the same direction as the rollers 1 and 2, it is driven at a speed deviating from the speed of the rollers thereby allowing relative movement of the belt and the roller surfaces.

The width of the belt 25 is such that it corresponds to at least the axial length of the rollers 1 and 2. In order to prevent the material stripped during the polishing or grinding process from collecting within the surface perforations of rollers 1 and 2, suction devices are arranged on both sides of the belt 25 in the area of the rollers 1 and 2 and aimed at the treatment points in a manner that is not shown in detail.

Figure 3:
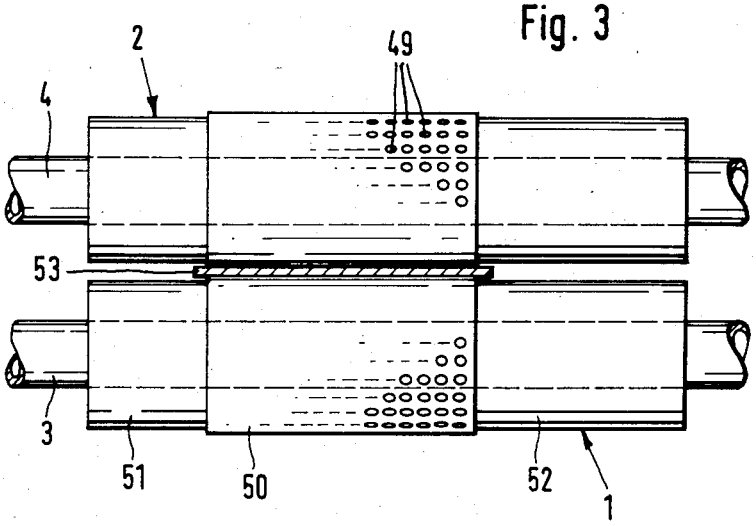
FIG. 3 is a top view of two friction rollers being treated simultaneously by a belt provided with a polishing or grinding coating in accordance with a preferred embodiment of the invention.

In an advantageous aspect according to FIG. 3, two rollers 1 and 2 are provided with sections 50, 51 and 52 of different diameters over their axial length. Only the center section 50 of the rollers 1 and 2, provided with perforations 49, comprises the wedge-shaped gap in which the yarn formation within a spinning unit takes place. Only in this area is it necessary to maintain a very precise concentricity of the two rollers 1 and 2 as well as very exact dimensions of the wedge-shaped gap. The differences in diameter of the various sections of the rollers are shown to be very exaggerated in FIG. 3. In reality the differences in section diameters as well as the separation of the rollers amounts to only a few hundredths of a millimeter. In a spinning unit, a fiber feeding channel forming a so-called scatter zone in which the feeding of fibers takes place leads into this center section. Only in this area must the wedge-shaped gap maintain exact dimensions with respect to concentricity. Accordingly, it is sufficient in this case to keep the belt 53 coated with a polishing or grinding coating on both sides only to the extent necessary to cover the center section 50.

Figure 4:
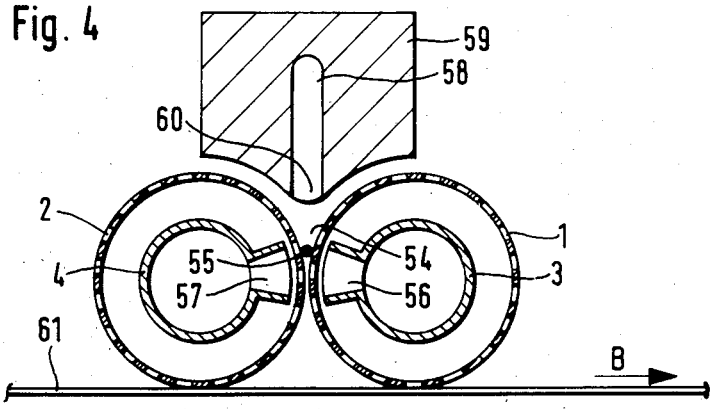
FIG. 4 is a cross sectional view through a spinning unit of an open-end friction spinning machine in the region of a pair of friction rollers forming a wedge-shaped gap serving as the yarn forming point.

FIG. 4 shows a cross sectional view of a spinning unit in which the rollers 1 and 2 having a perforated surface are separated by a small gap of a few hundredths of a millimeter. The tube-shaped suction inserts 3 and 4 are clamped into bearing holders which correspond to the holders 6, 7 and 14 of the receiving means for the inserts 3 and 4. The two rollers 1 and 2 are driven in the same tangential direction (indicated by arrow B) by a tangential belt 61 contacting their surfaces. The formation of the yarn 55 takes place in the narrow region of the wedge-shaped gap 54 between the two rollers 1 and 2. Opposite this wedge-shaped gap 54 is the mouth 60 of a fiber feeding channel 58 which is a component of a housing part 59. Via this fiber feeding channel 58, fibers are fed to the wedge-shaped gap 54. A vacuum is produced within the suction inserts 3 and 4 which results in an air current flowing into the wedge-shaped gap 54 by means of which the forming yarn 55 is held and the fibers are fed.

Figure 2:
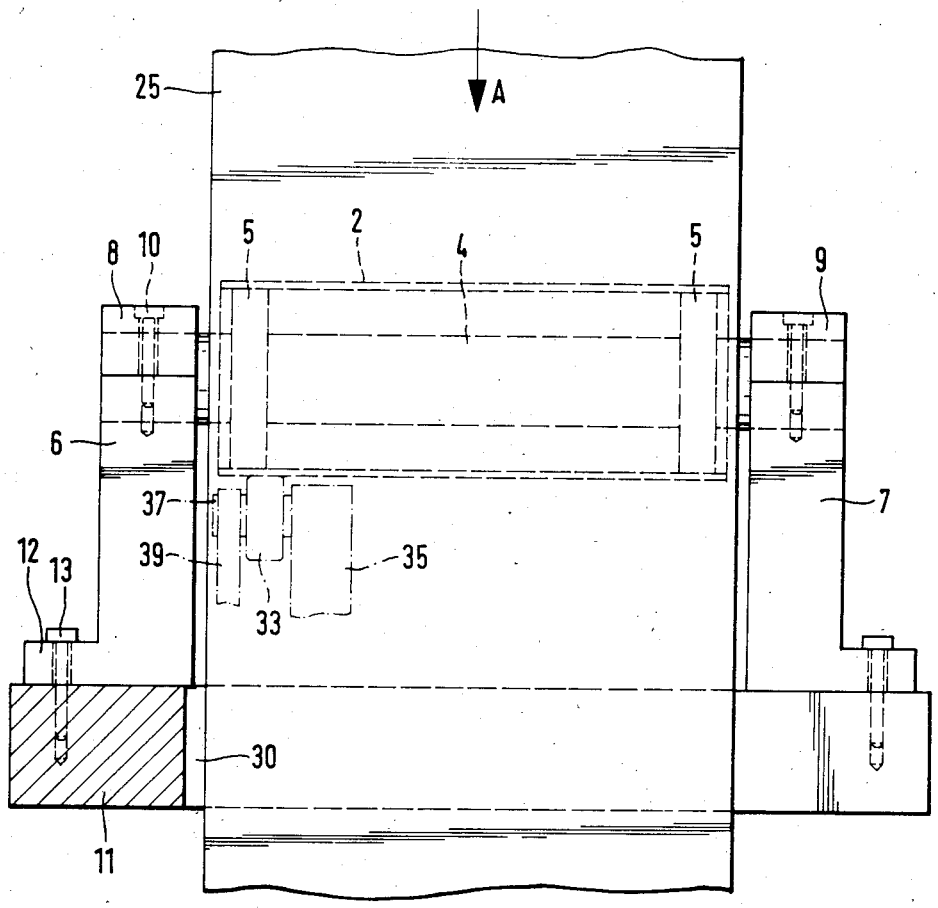
FIG. 2 is a sectional view taken along the line II—II of FIG. 1.

As a modification of the apparatus shown in FIGS. 1 and 2, it is also contemplated to pre-mount the rollers 1 and 2 with their bearings 5 and the suction pipes 3 in bearing blocks before the last preparing cycle. By means of these bearing blocks, the rollers may then later be assembled in the spinning unit. These bearing blocks which hold the rollers 1 and 2 in their final operational position may then be assembled in the apparatus in such a way that the belt 25 can run between the two rollers 1 and 2. However, in this case, it must be provided that the bearing blocks permit an adjustment of the wedge-shaped gap so that the belt 25 can be run between the rollers 1 and 2.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A process for treating cylindrical surfaces of two rollers of a pair of friction rollers used in an open-end friction spinning unit prior to installation in said spinning unit having said rollers of said pair of rollers arranged in a position that corresponds to their operational position forming a wedge-shaped yarn-forming gap along the length of which gap yarn is formed, comprising:

rotatably mounting said rollers of said pair of rollers adjacent one another on receiving means in an apparatus outside said spinning unit in a position that corresponds to their relative operational position in said spinning unit, rotating each said rotatably mounted roller about its longitudinal axis, and treating said cylindrical surfaces of each said roller simultaneously with a common surface treating means.

2. A process according to claim 1, wherein said pair of rollers is installed together in said open-end friction spinning unit after said surface treating.

3. A process according to claim 1, wherein said pair of rollers are mounted in a position corresponding to said operational position in said spinning unit during said treating with a common surface treating means.

4. A process according to claim 3, wherein said treating means comprises grinding means.

5. A process according to claim 3, wherein said treating means comprises polishing means.

6. A process according to claim 1, wherein said rollers of said roller pair are biased against said treating means by biasing means.

7. A process according to claim 1, wherein said biasing means are spring biasing means.

8. A process according to claim 6, wherein said treating means is disposed between said rollers of said roller pair during said treating.

9. A process according to claim 8, wherein said treating means comprises one of grinding and polishing means.

10. A process according to claim 9, wherein said treating means comprises belt means with said one of grinding and polishing means on the oppositely facing belt surface of the belt means.

11. A process according to claim 1, wherein each roller of said pair of rollers is rotated at a different rotational speed during said treating with a common surface treating means.

12. A process according to claim 1, wherein each said roller of said pair of rollers is rotated in a same rotational direction during said treating with a common surface treating means.

13. A process according to claim 1, wherein said treating means is driven at a first tangential velocity, said rollers are rotated at a second tangential velocity, said first and second tangential velocities being unequal, thereby causing relative movement between said surfaces of said rollers and said treating means during said treating with a common surface treating means.

14. A process according to claim 1, wherein said rollers of said pair of rollers are connected by connecting means, therby forming one structural unit, prior to mounting in the spinning unit.

15. An apparatus for treating cylindrical surfaces of a pair of friction rollers used in an open-end friction spinning unit prior to installation in said spinning unit having rollers of said pair of rollers arranged in a position that corresponds to their operational position forming a wedge-shaped yarn-forming gap, comprising:

receiving means for rotatably mounting said rollers of said roller pair adjacent one another outside said spinning unit in a position that corresponds to their relative operational position in said spinning unit, driving means for rotating said rollers about their longitudinal axes, and common treating means for simultaneously treating said surfaces of said rollers, further comprising biasing means for biasing said rollers against said common treating means, wherein said common treating means is disposed between said rollers, and wherein said common treating means comprises belt means having polishing means on both sides thereof.

16. An apparatus for treating cylindrical surfaces of a pair of friction rollers used in an open-end friction spinning unit prior to installation in said spinning unit having rollers of said pair of rollers arranged in a position that corresponds to their operational position forming a wedge-shaped yarn-forming gap, comprising:

receiving means for rotatably mounting said rollers of said roller pair adjacent one another outside said spinning unit in a position that corresponds to their relative operational position in said spinning unit, driving means for rotating said rollers about their longitudinal axes, and common treating means for simultaneously treating said surfaces of said rollers, wherein said receiving means comprises first stationary holder means for one roller of said roller pair and second holder means for a second roller of said roller pair, said second holder means being displaceable relative to said first stationary holder means, wherein said common treating means comprises belt means having grinding means on both sides thereof.

17. An apparatus for treating cylindrical surfaces of a pair of friction rollers used in an open-end friction spinning unit prior to installation in said spinning unit having rollers of said pair of rollers arranged in a position that corresponds to their operational position forming a wedge-shaped yarn-forming gap, comprising:

receiving means for rotatably mounting said rollers of said roller pair adjacent one another outside said spinning unit in a position that corresponds to their relative operational position in said spinning unit, driving means for rotating said rollers about their longitudinal axes, and common treating means for simultaneously treating said surfaces of said rollers, further comprising biasing means for biasing said rollers against said common treating means, wherein said treating means comprises selectively driven endless belt means.

18. Apparatus according to claim 17, wherein said belt means has a width and said cylindrical surface has a longitudinal dimension, said width being at least as great as said longitudinal dimension.

19. Apparatus according to claim 17, wherein said belt means has a belt width and said cylindrical surfaces extending with a yarn forming gap portion thereof having a greater diameter than the adjacent end portions at the rollers, said belt width being smaller than the length of the cylindrical surfaces and larger than the length of the yarn forming gap portion.

20. A process for treating cylindrical surfaces of two rollers of a pair of friction rollers used in an open-end friction spinning unit having said rollers of said pair of rollers arranged in a position that corresponds to their operational position forming a wedge-shaped yarn-forming gap along the length of which gap yarn is formed, comprising:

rotatably mounting said rollers of said pair of rollers adjacent one another on receiving means, rotating each said rotatably mounted roller about its longitudinal axis, and treating said cylindrical surfaces of each said roller simultaneously with a common surface treating means, said common surface treating means comprising a belt means travelling between said rollers.

21. An apparatus for treating cylindrical surfaces of two rollers of a pair of friction rollers used in an open-end friction spinning unit having said rollers of said pair of rollers arranged in a position that corresponds to their operational position forming a wedge-shaped yarn-forming gap along the length of which gap yarn is formed, comprising:

receiving means for rotatably mounting said rollers of said roller pair adjacent one another, driving means for rotating said rollers about their longitudinal axes, and common surface treating means for simultaneously treating said surfaces of said rollers, said common surface treating means comprising a belt means travelling between said rollers.

* * * * *